United States Patent [19]

Pham Van

[11] 4,148,085

[45] Apr. 3, 1979

[54] INTERCONNECTION CIRCUIT-BREAKER AND ELECTRIC POWER INSTALLATION EMPLOYING SAME

[75] Inventor: Doan Pham Van, Meyzieu, France

[73] Assignee: Delle-Alsthom, Villeurbanne, France

[21] Appl. No.: 853,789

[22] Filed: Nov. 21, 1977

[30] Foreign Application Priority Data

Nov. 24, 1976 [FR] France ..... 76 35363

[51] Int. Cl.[2] ..... H01H 33/16

[52] U.S. Cl. ..... 361/13; 361/58

[58] Field of Search ..... 361/10, 13, 20, 21, 361/58

[56] References Cited

U.S. PATENT DOCUMENTS

| | | | |
|---|---|---|---|
| 3,538,278 | 11/1970 | Rathbun | 361/13 X |
| 3,543,047 | 11/1970 | Renfrew | 361/13 X |
| 3,777,178 | 12/1973 | Gratzmuller | 361/10 X |
| 4,042,963 | 8/1977 | Kriechbaum | 361/20 |
| 4,075,673 | 2/1978 | Thuries | 361/10 |

*Primary Examiner*—Harry E. Moose, Jr.

*Attorney, Agent, or Firm*—Sughrue, Rothwell, Mion, Zinn and Macpeak

[57] ABSTRACT

High-voltage interconnection circuit-breaker, having connected in parallel, in the first instance a main chamber, having a cut-out power, comprising a rapid functioning on opening and provided for an opening-closing cycle; in the second instance a very rapid closing chamber having a closing power and resistance to overcurrents which lasts a very short time; and in the third instance in series, a resistor and a cut-out chamber for the current reduced by the resistor.

9 Claims, 6 Drawing Figures

INTERCONNECTION CIRCUIT-BREAKER AND ELECTRIC POWER INSTALLATION EMPLOYING SAME

FIELD OF THE INVENTION

The invention relates to a high-voltage circuit-breaker and more particularly to a circuit-breaker used for the interconnection of networks having several power sources.

BACKGROUND OF THE INVENTION

When networks are fed by several interconnected sources, an interconnection circuit-breaker must be able to break short-circuit current which is the sum of the currents discharged by several of these sources. This is why it has been sought to reduce the magnitude of the cut-out currents borne by the circuit-breakers in such installations.

Thus, in an installation comprising a generator connected to two high-voltage transformers ensuring an interconnection between two networks, such as that which is the object of U.S. Pat. application No. 713,474 of Aug. 11, 1976, the protection device used allows a reduction in the cut-out powers of the circuit breakers of the generators, but the initial short-circuit current is passed for a relatively long time.

Indeed, generator circuit-breakers have a high rated current and are generally air-insulated devices. They include heavy moving contacts with relatively long strokes and a fairly long operation time results therefrom.

Now, when a fault can draw current from different interconnected sources, it is advantageous to:

- reduce very rapidly the power supply supplied by at least one of the sources, preferably the most powerful, in order to limit the damage caused by a high short-circuit current;
- maintain the stability of the network and the synchronization between the sources by the insertion of a connection resistor, generally a resistor with a fairly low ohmic value; and
- reduce the duration of the current flow in the connection resistor in order to reduce the energy dissipated in this resistor and consequently its bulk.

SUMMARY OF THE INVENTION

In accordance with the invention, these conditions can be satisfied by means of a circuit-breaker comprising, in parallel with a main rapid cut-out chamber which can effect an opening-closing cycle, a very rapid device and a resistor in series with an auxiliary cut-out chamber.

The invention provides a high-voltage circuit-breaker, characterized in that it comprises a main rapid-opening cut-out chamber disposed in parallel firstly with a circuit comprising a resistor for limiting the short-circuit current and an auxiliary cut-out chamber having a cut-out power corresponding to this limited current and secondly with a rapid closing chamber, said main cut-out chamber operating under the effect of a short circuit from its closed position according to a cycle comprising an opening position followed by a closing position.

In accordance with one characteristic, during the operation cycle, the auxiliary cut-out chamber being closed, a sequence of operations causes firstly the opening of the main cut-out chamber and the closing of the closing chamber, the opening of the auxiliary chamber, the closing of the main cut-out chamber, the opening of the closing chamber and the closing of the auxiliary chamber.

In accordance with another characteristic, the circuit-breaker comprises several main cut-out chambers disposed in series and one or several closing chambers are each disposed in parallel with the terminals of one or several of these main cut-out chambers.

The characteristics and advantages of the invention will become apparent from the description of various embodiments given by way of example with reference to the accompanying drawings.

DESCRIPTION OF THE PREFERRED EMBODIMENTS

Figure 1:
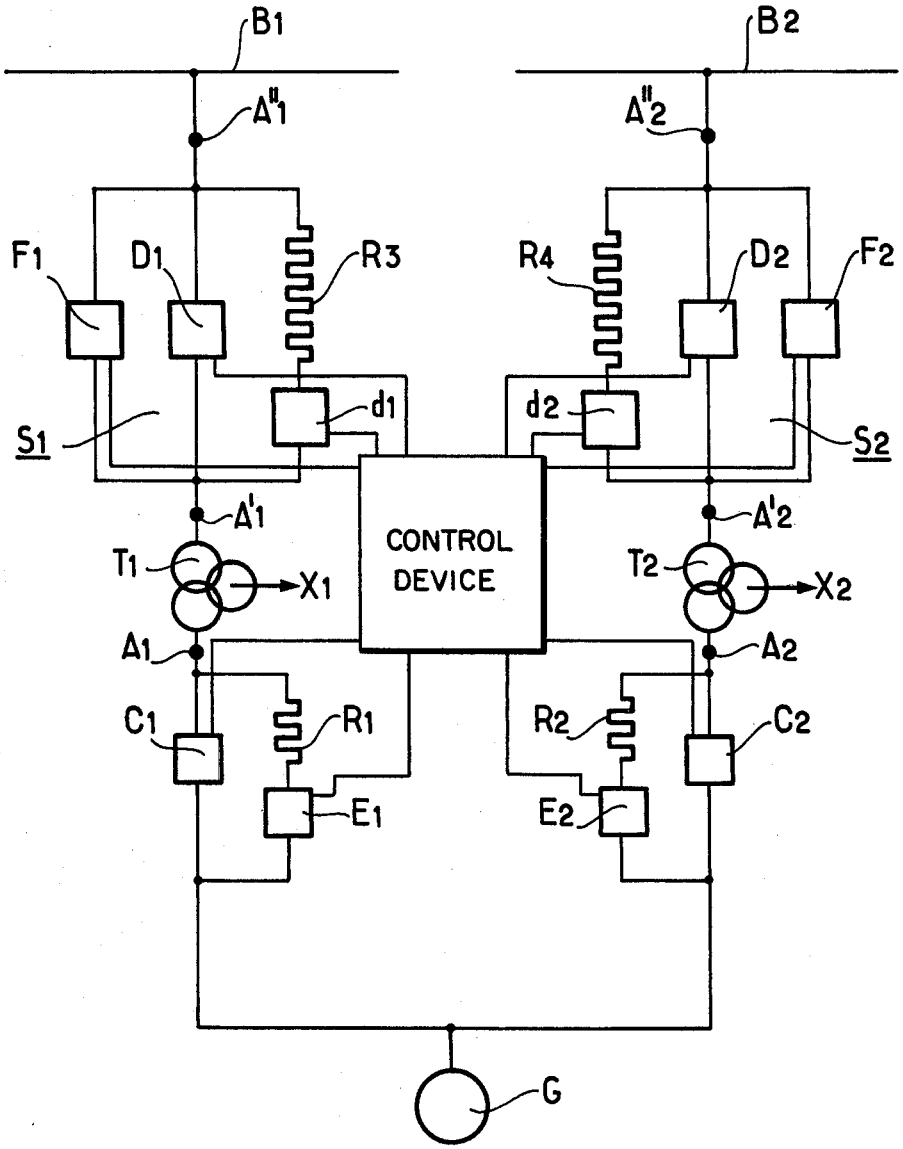
FIG. 1 is a circuit diagram showing schematically interconnecting circuit-breakers in according with the invention and applied to the interconnection of a generator with two networks.

In FIG. 1, $S_1$ and $S_2$ designate an assembly of high-voltage interconnection circuit-breakers in accordance with the invention, disposed respectively between high-voltage networks $B_1$ and $B_2$ and step-down transformers $T_1$ and $T_2$. These transformers are themselves interconnected with a generator G via protection circuit-breakers $C_1$ and $C_2$ each shunted by an auxiliary cut-out chamber $E_1$ and $E_2$ in series with a limiting resistor $R_1$ and $R_2$. The circuit-breakers $C_1$ and $C_2$ and their shunting devices are analogous to those described in U.S. Pat. application No. 713,474 of Aug. 11, 1976, in which the resistor $R_1$ (or $R_2$) is intended to damp the transient restoration voltage during the cut-out and $E_1$ (or $E_2$) is an auxiliary cut-out chamber cutting out the current limited by the resistor $R_1$ (or $R_2$).

The circuit-breakers $S_1$ and $S_2$ comprise main cut-out chambers $D_1$ and $D_2$ whose total fault elimination time is very short (for example one period of the short-circuit current). Resistors constituted by opening resistors $R_3$ and $R_4$ in series with the auxiliary cut-out chambers $d_1$ and $d_2$ are disposed in parallel with the main chambers $D_1$ and $D_2$, as well as closing chambers $F_1$ and $F_2$ allowing a very rapid shunting of the resistors $R_3$ and $R_4$ in a rapid opening-closing cycle, immediately after the cut-out of the chambers of the circuit-breakers $C_1$ (or $C_2$) and a long time before the re-closing of the main contacts of the chambers $D_1$ (or $D_2$).

Such dispositions allow a very substantial reduction in the duration of the current flow in the resistors $R_1$ (or $R_2$), and hence of their size.

The identical resistors $R_3$ and $R_4$ are dimensioned in such a way that in the opening position of the chambers $C_1$, E1 and $D_2$ with a fault at $A_1$ for example, the generator G continues to discharge sufficient current via $C_2$, $d_2$ and $R_4$ to remain synchronised with the network $B_2$ and to supply energy to the auxiliary transformers $X_2$ via the transformer $T_2$.

Figure 2:
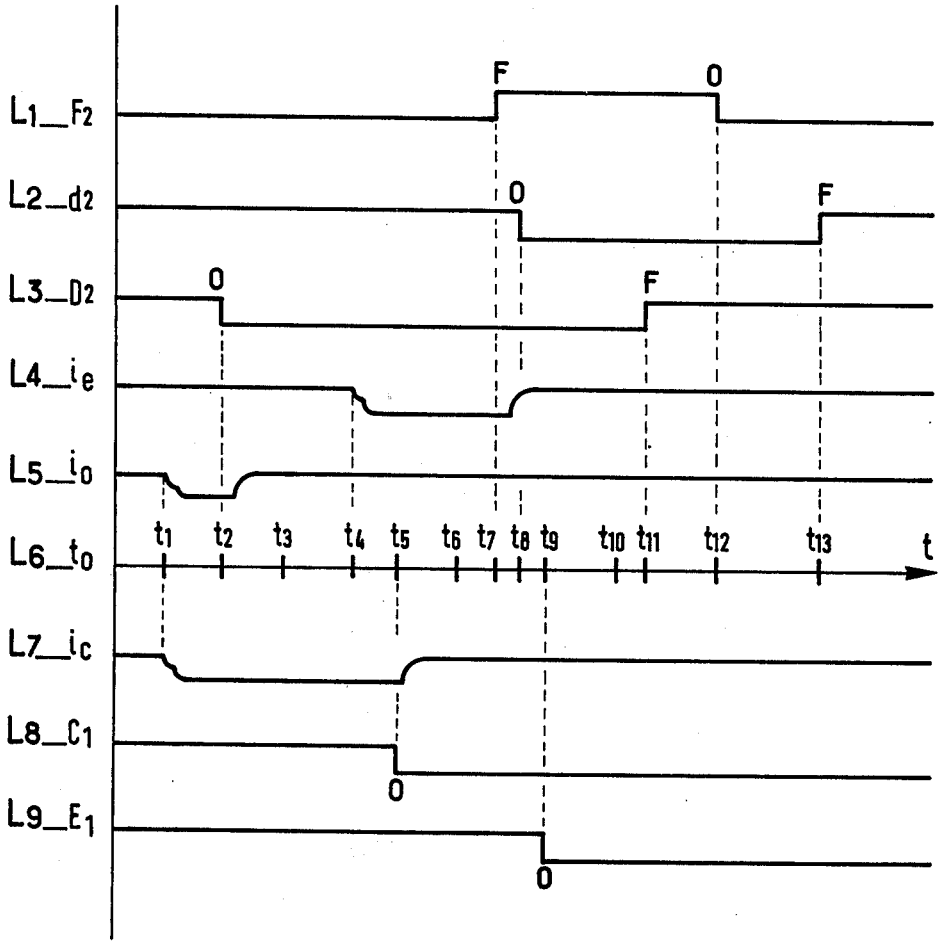
FIG. 2 is a graph showing schematically the operating sequence of the circuit-breaker when there is a short-circuit.

This leads to a sequence of operations schematically shown by the curved lines of FIG. 2 corresponding successively to the following parameters:

$L_1$ to the contacts of the closing chamber $F_2$,
$L_2$ to the contacts of the auxiliary chamber $d_2$,
$L_3$ to the contacts of the main cut-out chamber $D_2$,
$L_4$ to the current ie of the closing curve (not shown) of the main cut-out chamber $D_2$,
$L_5$ to the current io of the opening coil (not shown) of the main cut-out chamber $D_2$,
$L_6$ to the time axis,
$L_7$ to the current ic of the opening coil (not shown) of the main chamber of the circuit-breaker $C_1$,
$L_8$ to the contacts of the main cut-out chamber of the cut-out switch $C_1$,
$L_9$ to the contacts of the auxiliary cut-out chamber $E_1$ of the disjunctor $C_1$.

The cut-out chamber of the circuit-breaker $C_1$ (or $C_2$) effects a simple opening function, the cut-out chamber $C_1$, $C_2$, $E_1$ and $E_2$ being initially closed.

The main cut-out chamber $D_2$ (or $D_1$) effects a rapid opening-closing function, the cut-out chambers $D_1$, $D_2$, $d_1$ and $d_2$ being initially closed and the closing chambers $F_1$ and $F_2$ being initially open; $F_2$ (or $F_1$) operates only on a closing order.

When a fault appears, for example at the point $A_1$ of FIG. 1, at an instant $t_o$, the opening order is given simultaneously at the instant $t_1$ to the circuit-breakers $C_1$ and $D_2$. The opening time of the chamber $D_2$ being very short, this chamber opens first at the instant $t_2$; the cut-out of the fault current occurs at the instant $t_3$, where the resistor $R_4$ is inserted with the auxiliary cut-out chamber $d_2$ and limits the short-circuit coming from the network $B_2$.

The short-circuit current passing through the chamber $C_1$ is then reduced to the sum of the current discharged by the generator G and of the low value resistance current coming from the network $B_2$ passing through the resistor $R_4$. The chamber $C_1$ opens at the instant $t_5$ and, after the cut-out of the short-circuit current, inserts at the instant $t_6$ the resistor $R_1$ which damps the transient restoring voltage appearing at the terminals of the chamber $C_1$.

The generator C can then supply energy to the auxiliary transformers $X_2$ via the transformer $T_2$ and to the network $B_2$ via the transformer $T_2$ and the resistor $R_4$. The auxiliary chamber E1 opens at the instant $t_9$ and interrupts the current passing through $R_1$ at the instant $t_{10}$. The generator is then completely isolated from the fault $A_1$.

The closing chamber $F_2$ which receives the closing order, for example at $t_4$ after the insertion of the resistor $R_4$, can close at the instant $t_7$ as soon as the chamber $C_1$ is cut out at the instant $t_6$, this allowing the generator again to supply, at least partially, the network $B_2$. The closing chamber $F_2$ opens automatically at the instant $t_{12}$ after the closing at the instant $t_{11}$ of the main contacts of the chamber $D_2$. The auxiliary chamber $d_2$ opens at the instant $t_8$ after the closing of the contacts of the closing chamber $F_2$ and closes again at the instant $t_{13}$.

In the case of simple opening of the chamber $D_2$, only the contacts of the chambers $D_2$ and $d_2$ operate. These chambers open at the instants $t_2$ for $D_2$ and $t_8$ for $d_2$.

If the fault occurs at $A_2$, the chambers $D_1$ and $C_2$ open and operation is symmetrical.

The rapidity of operation of the chambers $D_1$ and $D_2$ also protect effectively the line sections $A'_1 B_1$ and $A'_2 B_2$. Indeed, if the fault appears at $A''_1$ (or $A''_2$), the opening of only the circuit-breaker $D_1$ (or $D_2$) is sufficient. This circuit-breaker rapidly isolates the generator from the fault and allows the direct supplying of the auxiliary transformers $X_1$ (or $X_2$) via the transformers $T_1$ (or $T_2$).

Faults at $A'_1$ (or at $A'_2$) cause operation of the circuit-breakers which is identical to that caused by faults at $A_1$ (or $A_2$).

When the section $A'_1 B_1$ (or $A'_2 B_2$) is a long line (unit remote from the generator), the chambers $D_1$ (or $D_2$) protect this line like a conventional circuit-breaker, but eliminate the fault very rapidly.

The closing chamber $F_1$ or $F_2$, which allows rapid closing of the circuit before the contacts of the main chamber $D_1$ or $D_2$ have closed has the following characteristics:

The closing time is very short (for example in one period or one and a half period);
The contacts have a closing power and short duration resistance to overcurrents (for example during fifty or so milliseconds).
After the closing these contacts can open automatically in a time of the order of 50 ms between closing and opening. These contacts, whose opening position is the normal position do not have to withstand rated current. The closing chamber, which opens only after the closing of the main chamber ($D_1$ (or $D_2$) has no cut-out power.
In the opening position, the closing chamber is filled with an insulating fluid under pressure (or otherwise) allowing the voltage applied to the terminals of the main chamber(s) to be held. The nature of this fluid, its pressure or simultaneously its nature and its pressure can be different from those used in the main cut-out chamber D.
The use of gas blast during the closing centers and cools the pre-priming arc and can increase the closing power.
The contacts can be either butt contacts or contact fingers.
A special closing order causes the movement of the contacts.

Figure 3:
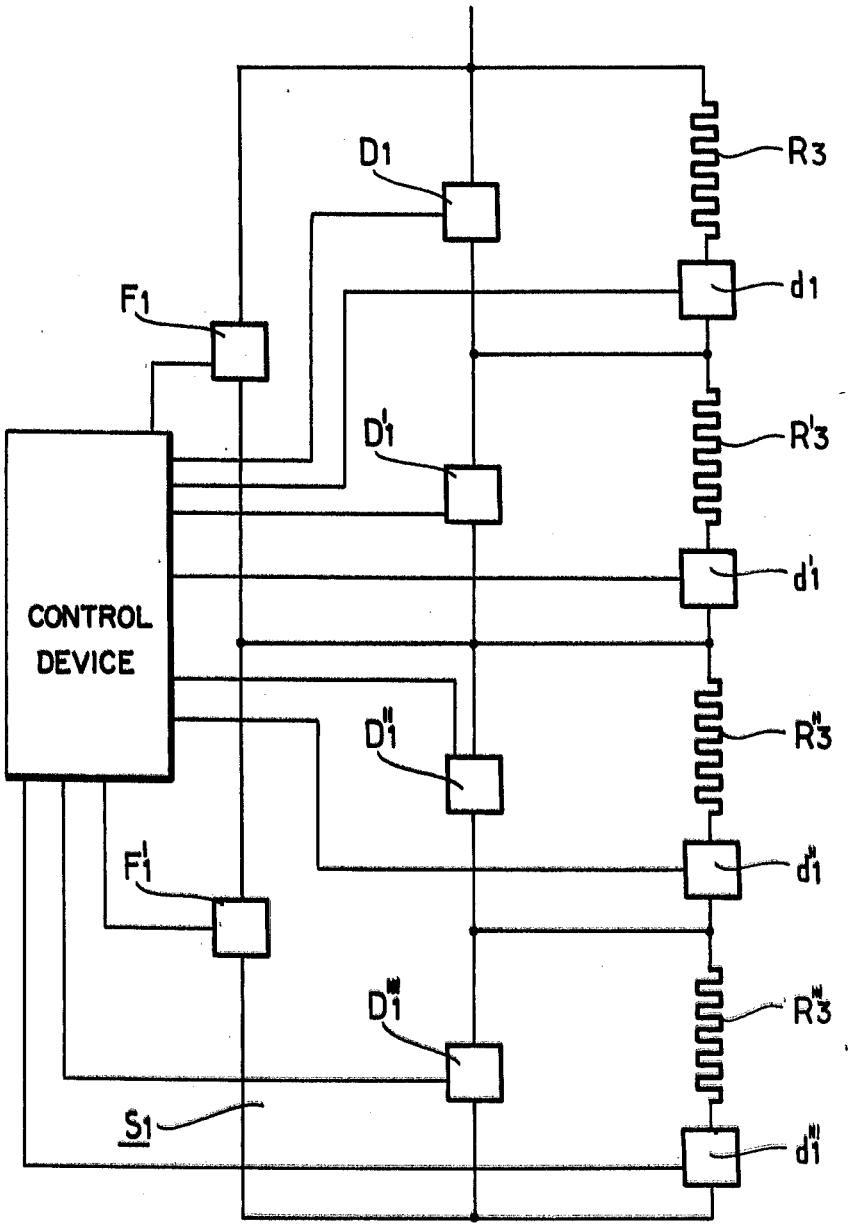
FIG. 3 is a circuit diagram showing a variant embodiment of an interconnection circuit-breaker.

In a variant, each interconnection circuit-breaker can comprise several main chambers in series, but the number of the closing chambers is equal to or less than that of the main chambers. Thus, in the example of FIG. 3, there are four main chambers in series $D_1$, $D'_1$, $D''_1$ $D'''_1$, but there are only two closing chambers in series, $F_1$ for $D_1$ and $D'_1$ and $F'_1$ for $D''_1$ and $D'''_1$.

Further the closing chambers can be partially incorporated in the main chambers or otherwise.

Besides the example of FIG. 1, several other non-limiting cases of application of the invention can be cited.

Figure 4:
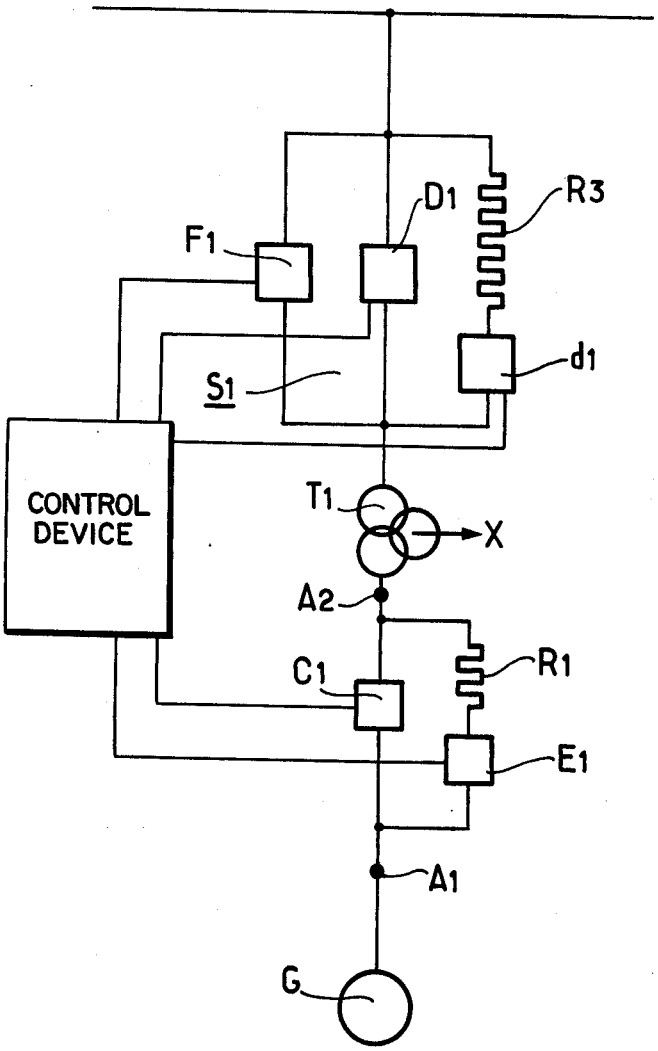
FIG. 4 is a circuit diagram showing schematically the application of an interconnection circuit-breaker between a generator and a network.

The diagram in FIG. 4 corresponds to a generator G supplying a single transformer $T_1$.

If the fault appears at the point $A_1$, when there is no circuit-breaker $D_1$ the circuit-breaker $C_1$ of the generator must cut the short-circuit current of the network and on a powerful network this current can correspond to a multiple of the short-circuit current of the generator G. With this diagram, the rapid cut-out of the chamber $D_1$ inserts the resistor $R_3$ and reduces the short-circuit current before the opening of the contacts of the chamber $C_1$. The current in the fault is reduced to the sum of the short-circuit current of the generator and of a low value resistance current. The cut-out chamber of the circuit-breaker $C_1$ has only this circuit-breaker to cut out. As soon as the main chamber of the circuit-breaker $C_1$ is cut out at the instant $t_6$ (FIG. 2), the network, by means of the transformer $T_1$, can supply energy to the auxiliary transformers $X_1$, firstly through the resistor $R_3$ then through the chamber $F_1$, when the contacts of this chamber have closed.

If the fault appears at the point $A_2$, the main chamber of the circuit-breaker $C_1$ cuts the short-circuit current of the generator.

Thus, due to the use of the circuit-breaker $S_1$, whose main cut-out chamber $D_1$ closes rapidly, the maximum short-circuit current cut out by the circuit-breaker $C_1$, having a longer cut-out time than that of the chamber of the circuit-breaker $D_1$ is equal to the short-circuit current of the generator. In contrast, the cut-out chamber of the circuit-breaker C, must have a closing power and a resistance to overcurrents equal to the maximum short-circuit current of the installation.

The sequence of the operations remains analogous to that of the diagram of FIG. 1, the circuit-breaker $S_2$ being replaced by the circuit-breaker $S_1$.

Figure 5:
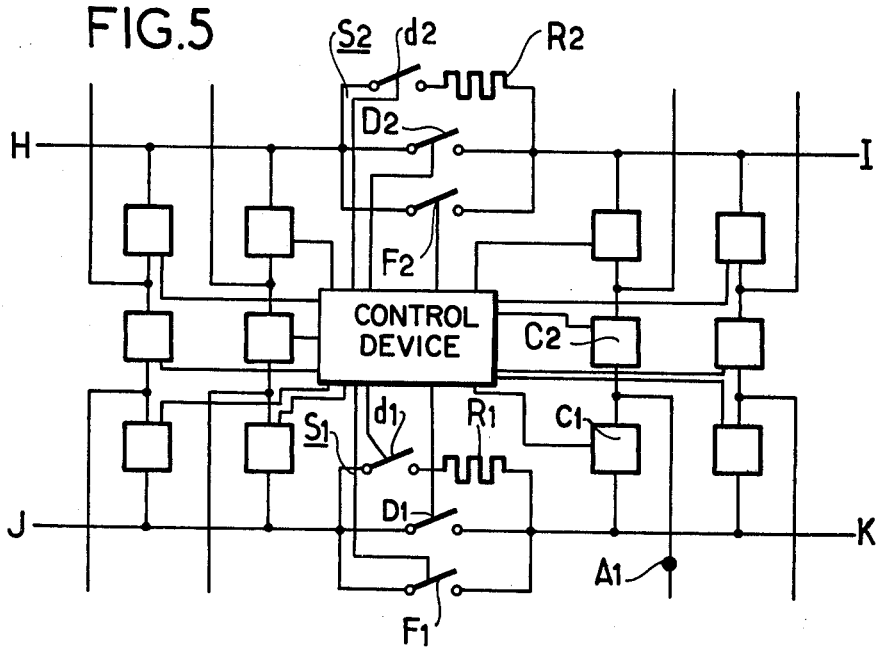
FIGS. 5 and 6 are circuit diagrams showing schematically the application of an interconnection circuit-breaker between sets of bars of interconnection units.
Figure 6:
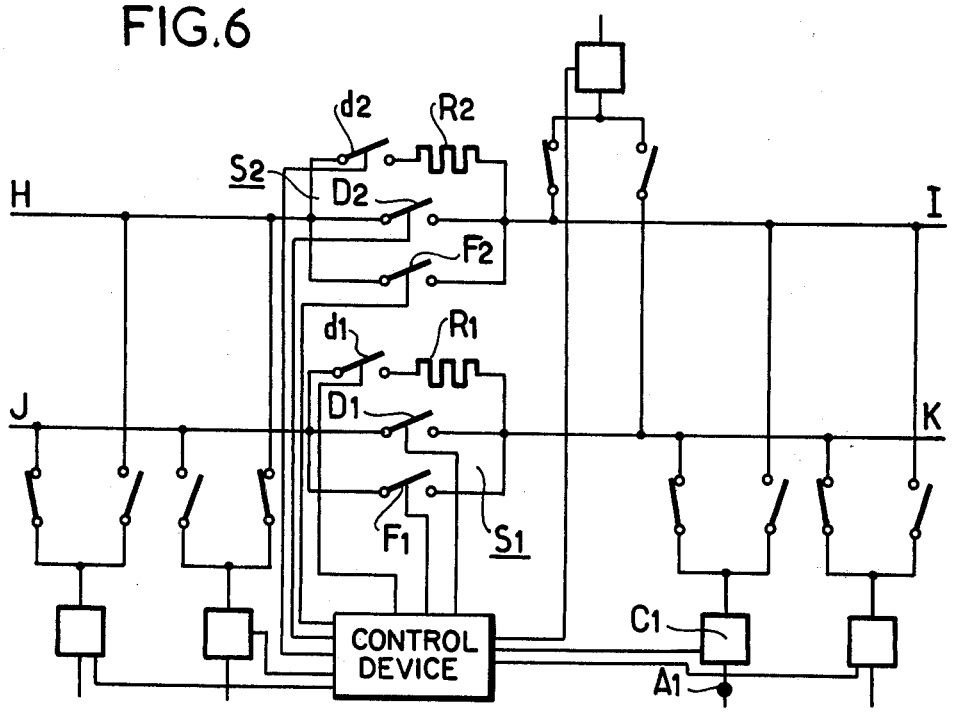

The diagrams of FIGS. 5 and 6 correspond by way of an example to units having two sets of bars, in which circuit-breakers $S_1$ and $S_2$, in accordance with the invention, are installed in series on the two sets of bars and interconnected each of the two half sets of bars H and I or J and K. FIG. 5 corresponds to a circuit called the "one and a half circuit-breakers" circuit and FIG. 6 corresponds to the circuit of the conventional unit with two sets of bars. In these two circuits, the operation of the rapid closing circuit-breaker is analogous.

The appearance of a fault at the point $A_1$ for example causes an opening-closing cycle of the rapid circuit-breakers $C_1$ and $C_2$. The opening of the cut-out chambers $D_1$ and $D_2$ of the circuit-breakers $S_1$ and $S_2$ inserts the resistor $R_1$, $R_2$ in the circuit, greatly reduces the fault current in the cut-out chambers of the circuit-breakers $C_1$ and $C_2$ and facilitates the cut-out of these chambers. The supply to the sound lines and the stability of the network are provided firstly by the rapid limitation of the fault current by the resistors R1 and R2, then the rapid closing of the contacts of the chambers $F_1$, $F_2$ which reduces the energy dissipated in the resistors $R_1$, $R_2$.

In the circuit of FIG. 6, where the two sets of bars are independent from each other, the opening of the circuit-breaker $S_1$ alone is sufficient for the fault at $A_1$.

The use of the rapid closing circuit-breakers $S_1$, $S_2$ limits the short-circuit current which the circuit-breakers $C_1$ and $C_2$ have to cut out, their operation time being longer and their current being substantially smaller than that corresponding to the maximum power of the network. In contrast, the closing power of the cut-out chambers of the circuit-breakers $C_1$ and $C_2$ must always correspond to the maximum short-circuit current on the set of bars.

Generally, besides the rapid opening-closing cycle, the rapid-closing circuit-breakers such as $S_1$ and $S_2$ can perform all the functions provided for by the standards: simple opening, simple closing, opening-closing-opening cycle . . .

In the open position, they can isolate two portions of circuit and when there is a fault on a set of bars, they can maintain a part of the unit under tension.

It is evident that the invention is in no way limited to the embodiments which have just been described and illustrated and which have been given only by way of an example; in particular, without going beyond the scope of the invention, some dispositions can be modified or some means can be replaced by equivalent means, or even some elements can be replaced by others liable to fulfill the same technical function or an equivalent technical function.

What is claimed is:

1. A high-voltage circuit-breaker comprising; at least one main rapid-opening cut-out chamber, means for connecting said main cut-out chamber in parallel firstly in a circuit comprising a resistor for limiting the short-circuit current and an auxiliary cut-out chamber having a cut-out power corresponding to this limit current and secondly in a circuit comprising a rapid closing chamber, and means for operating said circuit-breaker such that said main cut-out chamber operates under the effect of a short circuit, from a closed position according to a cycle comprising an opening position followed by a closing position.

2. The circuit-breaker according to claim 1, wherein the means for operating said circuit-breaker includes means for performing the following sequence of operations during the operation cycle, with the auxiliary cut-out chamber closed:

opening the main cut-out chamber while the closing chamber is closed;

opening the auxiliary chamber;

closing the main cut-out chamber; and opening the closing chamber while the auxiliary chamber is closed.

3. The circuit-breaker according to claim 2, wherein said at least one main cut-out chamber comprises a plurality of main cut-out chambers connected in series and wherein at least one closing chamber is connected in parallel with the terminals of at least one of the main cut-out chambers.

4. The circuit-breaker according to claim 1, wherein the closing chamber contains a first working fluid and the main cut-out chamber contains a second working fluid, and wherein said working fluids are different from each other and said chambers are operated under different conditions.

5. An electric power installation comprising:

a distribution network, a step-down transformer, a generator, at least one high voltage circuit-breaker, said high voltage circuit-breaker comprising at least one main rapid-opening cut-out chamber, means for connecting said main cut-out chamber in parallel, firstly in a circuit comprising a resistor for eliminating the short-circuit current and an auxiliary cut-out chamber having a cut-out power corresponding to said limited current, secondly in a circuit comprising a rapid closing chamber, means for operating said circuit-breaker such that said main cut-out chamber operates under the effect of a short-circuit from a closed position according to a cycle comprising an opening position followed by a closing position, and wherein said means for operating said circuit-breaker includes means for performing the following sequence of operations during the operation cycle with the auxiliary cut-out chamber closed:

opening the main cut-out chamber while the closing chamber is closed;

opening the auxiliary chamber;

closing the main cut-out chamber; and opening the closing chamber while the auxiliary chamber is closed;

and said installation further comprising means for connecting said circuit-breaker between said distribution network and said step-down transformer, and means for connecting said step-down transformer to said generator via a protection circuit-breaker.

6. The electric power installation according to claim 5, wherein said means for operating said circuit-breaker includes means for opening the protection circuit-breaker in between the opening of the main chamber and the closing of the closing chamber.

7. The electric power installation according to claim 5, wherein said installation includes two sets of high-voltage bars, and wherein said at least one circuit-breaker comprises circuit-breakers for each of two sets of high-voltage bars.

8. The electric power installation according to claim 5, wherein one of said circuit-breakers has an opening operation which is more rapid than that of the other circuit-breaker of said installation.

9. An electric power installation according to claim 5, wherein one of said circuit-breakers has a cut-out power which is in excess of that of the other circuit-breaker of the installation and has a closing power and an ability to withstand short-circuits which correspond to the maximum short-circuit current of the installation.

* * * * *